US006389905B1

(12) United States Patent
Thepot

(10) Patent No.: US 6,389,905 B1
(45) Date of Patent: May 21, 2002

(54) METHOD AND APPARATUS FOR MONITORING THE COMPACTION OF A FILL

(75) Inventor: Olivier Thepot, Paris (FR)

(73) Assignee: Societe Anonyme de Gestion des Eaux de Paris (SAGEP), Paris (FR)

( * ) Notice: Subject to any disclaimer, the term of this patent is extended or adjusted under 35 U.S.C. 154(b) by 0 days.

(21) Appl. No.: 09/429,483

(22) Filed: Oct. 29, 1999

(30) Foreign Application Priority Data

Oct. 30, 1998 (FR) ..... 98 13694

(51) Int. Cl.[7] ..... G01N 3/08
(52) U.S. Cl. ..... 73/818
(58) Field of Search ..... 73/818, 784, 157, 73/155, 12.12, 84, 702; 405/157, 271, 236, 179; 604/403; 367/61; 428/304.4; 442/373, 370

(56) References Cited

U.S. PATENT DOCUMENTS 4,650,367 A * 3/1987 Dietzler ..... 405/43
4,733,567 A * 3/1988 Serata et al. ..... 73/784
5,402,667 A * 4/1995 Atkinson et al. ..... 73/12.12
5,576,485 A * 11/1996 Serata ..... 73/152.17

FOREIGN PATENT DOCUMENTS

| | | |
|---|---|---|
| EP | 0 736 666 | 10/1996 |
| GB | 1 246 961 | 9/1971 |
| JP | 59-102009 | 6/1984 |
| JP | 62-165134 | 7/1987 |

* cited by examiner

*Primary Examiner*—Max Noori
*Assistant Examiner*—Octavia Davis
(74) *Attorney, Agent, or Firm*—Young & Thompson

(57) ABSTRACT

This method of monitoring the compaction of a fill for embedding a pipe includes the steps of applying a force to the fill so as to obtain a resulting deformation of the latter, measuring the deformation of the fill, computing the elastic modulus of the fill, determining the dry density of the fill form the computed elastic modulus and from the nature of the fill, and comparing the computed dry density with a dry density value corresponding to an optimum compaction of the fill. The force applied to the fill is applied via the pipe and the deformation of the fill is obtained by measuring and deformation of the pipe.

11 Claims, 2 Drawing Sheets

METHOD AND APPARATUS FOR MONITORING THE COMPACTION OF A FILL

BACKGROUND OF THE INVENTION

The present invention relates to a method of monitoring the compaction of a fill and in particular of that region of a fill which ensures that a pipe is embedded.

Such a fill must be sufficiently compacted, that is to say have a high enough density to constitute an effective foundation for the pipe, particularly when it is intended to run under a road.

It is known to use a penetrometer for monitoring the compaction of a fill.

Another known technique consists in using a gamma probe and in measuring the absorption of the gamma rays by the fill.

In general, these techniques do not make it possible to obtain a precise indication of the quality of the compaction of a fill, and in particular of the region for embedding a pipe, insofar as, on the one hand, this region is difficult to access and, on the other hand, the quality of the compaction in this region may vary rapidly, in the vertical direction between the raft and the key, and in the horizontal direction, the measurements being taken at discrete points.

SUMMARY OF THE INVENTION

The object of the invention is to remedy these drawbacks.

The subject of the invention is therefore a method of monitoring the compaction of a fill for embedding a pipe, comprising the steps consisting in:

- applying a force to the fill so as to obtain a resulting deformation of the latter,
- measuring the deformation of the fill,
- computing the elastic modulus of the fill from the applied force and from the measured deformation,
- determining the dry density of the fill from the computed elastic modulus and from the nature of the fill, and
- comparing the computed dry density with a dry density value corresponding to an optimum compaction of the fill,
- characterized in that the force applied to the fill is applied via the pipe and in that the deformation of the fill is obtained by measuring the deformation of the wall of the pipe.

According to one particular characteristic of the monitoring method according to the invention, the step of applying the force to the fill consists in exerting a radial force on two diametrically opposed regions of the wall of the pipe so as to make its cross section approximately oval.

Advantageously, the step of computing the elastic modulus of the fill comprises the step [sic] consisting in computing the stiffness of the fill, by computation of the ratio of the value of the applied force to the value of the resulting deformation, and in computing the modulus of elasticity of the fill from the computed stiffness.

The subject of the invention is also an apparatus for monitoring the compaction of a fill for embedding a pipe, for the implementation of a monitoring method as defined above, characterized in that it comprises means for applying a force to the wall of the pipe so as to deform it, means for measuring the resulting deformation of the wall of the pipe and a central processing unit to which the said measurement means are connected and comprising means for computing the dry density of the fill from the values of the applied force and from the resulting deformation of the wall of the pipe, and means for comparing the dry density value delivered by the computing means with a dry density value corresponding to an optimum compaction of the fill.

The monitoring apparatus according to the invention may furthermore comprise one or more of the following characteristics, taken separately or according to any technically possible combination:

- the means for applying a force to the wall of the pipe comprise at least one cylinder, and the apparatus furthermore comprises a pressure sensor which is placed in the fluid feed circuit for the or each cylinder and is connected to the central processing unit;
- it comprises two groups of at least one cylinder, the cylinder or cylinders of one of the groups exerting, in operation, a force in an opposite direction to that exerted by the cylinder or cylinders of the other group;
- each group of cylinders comprises a pair of cylinders placed on either side of the means for measuring the deformation of the pipe;
- it comprises two blocks for pressing against the internal surface of the wall of the pipe, each block being mounted on the active ends of the cylinders of one of the pairs of cylinders;
- each block has two opposed end regions, each provided with means for mounting on a cylinder, and a central region on the external face of which a circular plate for applying the force to the pipe is mounted;
- each circular plate and each block are provided with a hole for passage of the means for measuring the deformation of the wall of the pipe;
- each circular plate has a disk shape, the diameter of which is approximately equal to one tenth of the diameter of the pipe.

BRIEF DESCRIPTION OF THE DRAWINGS

Other characteristics and advantages will emerge from the following description, given solely by way of example, and with reference to the appended drawings in which.

DETAIL DESCRIPTION OF THE PREFERRED EMBODIMENTS

Figure 1:
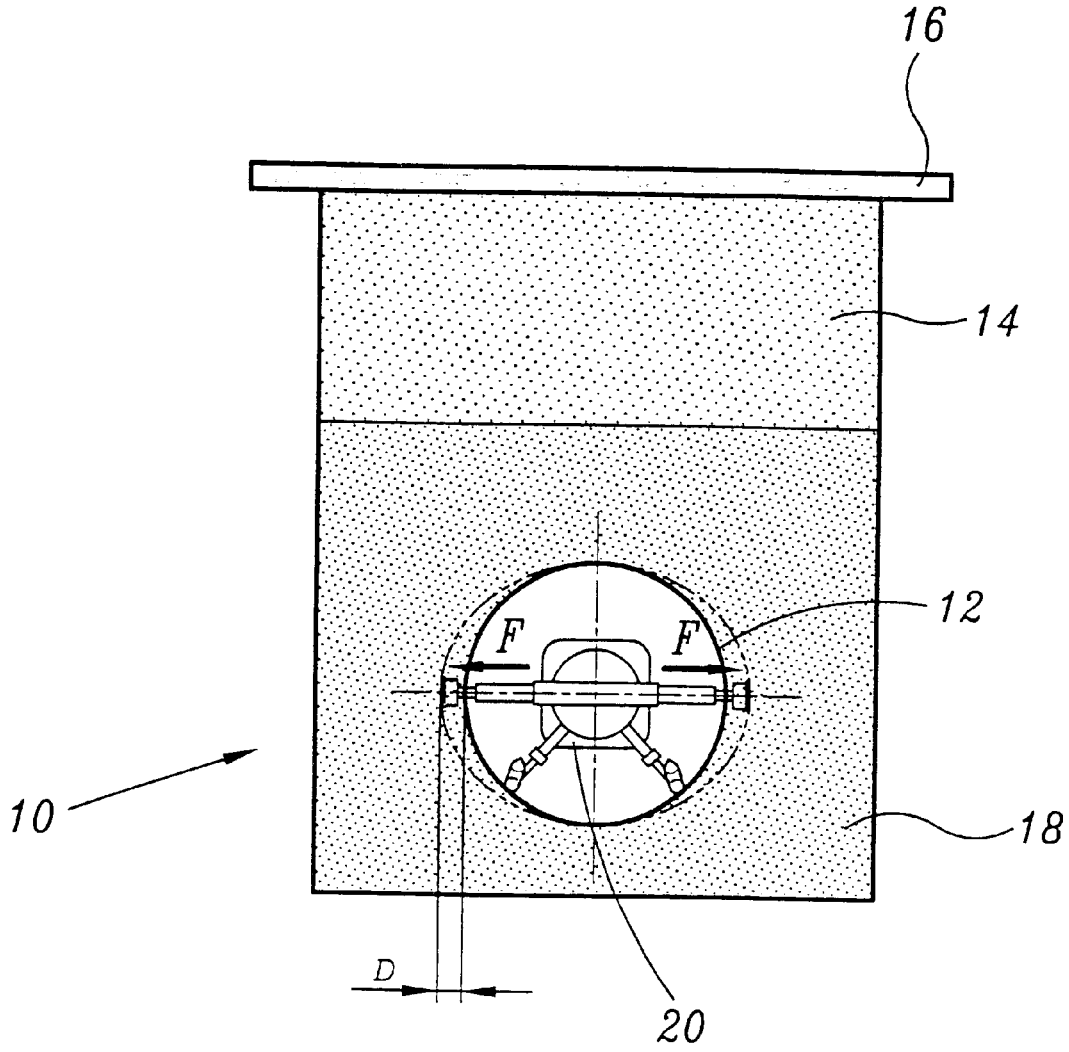
FIG. 1 is a schematic view showing a cross section of a fill before and after deformation.

FIG. 1 illustrates a cross-sectional view of a fill, denoted by the general numerical reference 10, in which a pipe 12 runs.

In the embodiment illustrated, the fill 10 comprises two regions, one of which, 14, constitutes a foundation for a road 16 and the other region of which, 18, constitutes a region for embedding the pipe 12.

FIG. 1 also illustrates an apparatus for monitoring compaction of the embedding region 18, the apparatus being denoted by the general numerical reference 20 and placed in the pipe 12.

This apparatus 20 monitors the compaction of the fill 10 by applying a force F to the internal surface of the wall of the pipe 12 so as to deform it, as represented by the dot/dash lines in this figure, this deformation being accompanied by a consecutive deformation of the embedding region 18 of the fill.

In order to obtain an indication of the quality of the compaction of this embedding region 18, the apparatus computes the dry density of the fill from the values of the applied force and from the deformation of the fill, as well as from the nature of the latter, and then compares the dry density thus computed with a dry density value corresponding to an optimum compaction of the fill.

The apparatus 20 for monitoring the compaction of the fill 10 will now be described with reference to FIG. 2.

This figure shows that the apparatus 20 comprises, mounted on a frame 22, means 24 for applying a force to the wall of the pipe 12 and means 26 for measuring the resulting deformation of the fill by measuring the deformation D of the wall of the pipe.

The means 24 for applying a force to the wall of the pipe comprise cylinders 28, 30, 32 and 34 placed in pairs in such a way that the cylinders 28 and 30 of one of the pairs exert, in operation, a force on the internal surface of the wall of the pipe 12 in an opposite direction to that exerted by the cylinders 32 and 34 of the other pair.

Figure 2:
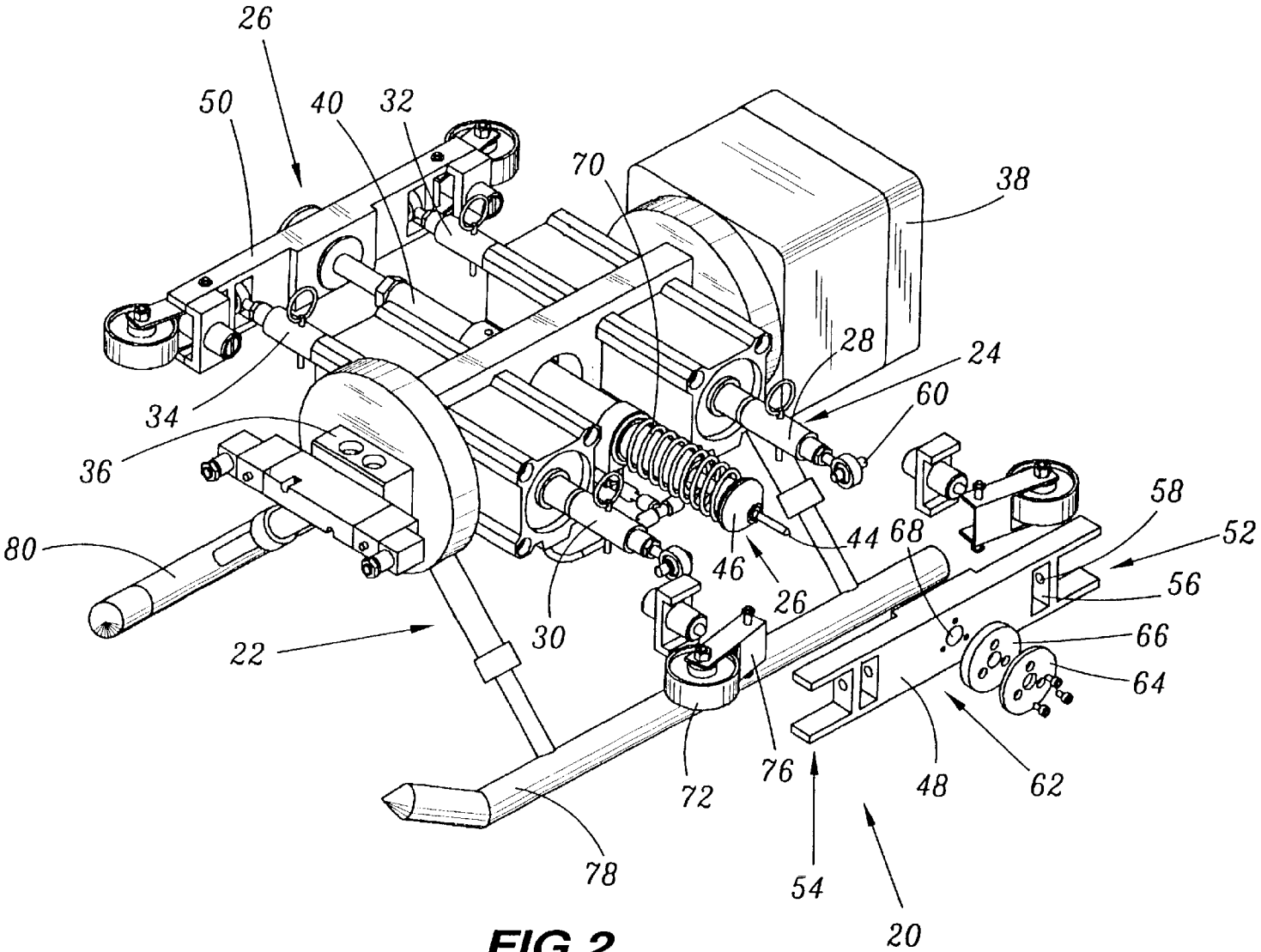
FIG. 2 is a partially exploded perspective view of an apparatus for monitoring the compaction of the fill in FIG. 1.

As may be seen in this FIG. 2, the cylinders of each of the pairs are placed on either side of the measurement means 26.

They consist, for example, of air cylinders capable of exerting a pressure within a range going from 0 to 10 bar on the pipe and are preferably double-acting cylinders, that is to say capable of being operated selectively in pull mode or in thrust mode.

The cylinders 28, 30, 32 and 34 are connected to a member 36 for connecting the cylinders to a pressurized-fluid feed supply (not shown).

A pressure sensor 38, of conventional type, is placed in the fluid feed circuit for each cylinder, between the connecting member 36 and the latter, for the purpose of measuring the force F applied to the wall of the pipe.

The means 26 for measuring the deformation of the wall 12 of the pipe comprise two measurement tubes 40 and 42 which extend, one in the extension of the other.

These measurement tubes 40 and 42 are conventional-type measurement tubes suitable for the envisaged use. They will therefore not be described in detail below.

However, it should be pointed out that they are each provided with an active end tip, such as 44, intended to be applied against the wall of the pipe and extending from a frustoconical head 46.

The force F exerted on the pipe is applied by means of two lateral blocks 48 and 50, each mounted on the active ends of a cylinder of one of the pairs.

To do this, each block 48 and 50 has two opposed end regions 52 and 54 each provided with a cutout, such as 56, in which an active end of a corresponding cylinder engages, and the walls of which are provided with holes, such as 58, in which holes studs, such as 60, carried by the active end of each cylinder engage.

Moreover, FIG. 2 shows that the active face of the central region 62 of each block 48 and 50 is equipped with a circular plate 64, for example fastened by screwing, with interposition of a washer 66, by means of which the force provided by the cylinders is applied to the pipe 12.

Each block 48 and 50, as well as each circular plate 64 and the washer 66 with which it is associated, are drilled with coaxial holes, such as 68, in which the active tip 44 of the measurement means engages, a spring 70 pressing the frustoconical head 46 of the latter so as to bear against the internal face of the corresponding block 48 and 50.

Each block is furthermore provided with castors, such as 72, which are mounted so as to swing on a support 76 which is mounted on the end regions 52 and 54 of each block.

The monitoring apparatus that has just been described is completed by a central processing unit (not illustrated) to which the measurement means 26 and the pressure sensor 38 are connected.

This central processing unit may be placed on the frame or be located remotely, outside the pipe 12. It includes, stored in memory, computing algorithms allowing the compaction of the fill to be monitored, as described in detail above.

Finally, the frame 22 is equipped with skids 78 and 80 on which the apparatus rests in the pipe. As a variant, these skids may be replaced with castors.

In order to monitor the compaction of the embedding region 18 of the fill 10, the apparatus 20 has to be placed in the pipe 12.

In the standby position, the skids 48 and 50 bear against the wall of the pipe 12 via the castors 72.

Next, as mentioned above, the cylinders are driven so that they apply a force F in two diametrically opposed regions of the pipe, so as to ovalize its cross section, as illustrated in FIG. 1.

The central processing unit receives as input the value D of the consecutive displacement of the wall 12 of the pipe, which represents the value of the deformation of the fill.

The stiffness of the fill is computed from a calculation of the overall stiffness R of the pipe, by determining the ratio of the value F of the applied force to the value D of the resulting deformation.

From the computed stiffness R, the central processing unit computes the elastic modules $E_s$ from the overall stiffness R and from the intrinsic stiffness of the pipe, using the following equation:

$$E_s \cong \frac{R_c}{D_m} \times R^{-1.62}$$

In which:

$D_M$ denotes the mean diameter of the pipe and

R denotes the centered reduced stiffness of the pipe defined by the equation:

$$R = \frac{R}{R_c} - 1R$$

$R_c$ denoting the intrinsic stiffness of the pipe in the open air, depending on the nature of the material used for the fill, for example equal to R/5 for a cast iron pipe, it being possible for this intrinsic stiffness to be measured directly or computed from the mechanical properties of the pipe.

From the elastic modulus $E_s$ and the nature of the fill, the central processing unit then computes the dry density $\gamma_d$ using the following equation:

$$\gamma_d = \frac{\gamma_s}{1 + \frac{A}{E_s}\sqrt{p'}} \tag{3}$$

where $\gamma_s$ denotes the density of the solid phase of the fill, which depends on its nature, p' denotes the effective pressure obtaining in the soil at the depth of the pipe, and A is a coefficient which depends on the nature of the fill.

Since the optimum compaction is obtained when the value of the dry density reaches a maximum value, known by the name "Optimum Proctor", the computed dry density $\gamma_d$ then simply has to be compared with a density value corresponding to the Optimum Proctor, from among a number of dry densities stored in memory in the central processing unit, each corresponding to an optimum compaction of the fill, for one type of material likely to occur in the composition of the fill.

After having taken a measurement, the cylinders 28, 30, 32 and 34 are operated in pull mode so as to exert a force opposing the force exerted by the spring 70 in order to reposition the blocks 48 and 50 in the standby position in which the castors 72 are applied against the wall of the pipe 12.

The apparatus may then be easily moved to another check point.

It is thus conceivable to carry out a very large number of checks along the pipe and therefore to monitor, approximately continuously, the entire length of a pipe.

Finally, it should be noted that the circular plates 64 are preferably in the form of a disk, the diameter of which is approximately equal to 1/10 of the diameter of the pipe so as to maintain mechanical similitude with the models used for determining the abovementioned equations allowing the dry density to be computed.

I claim:

1. A method of monitoring a compaction of a fill embedding a pipe permanently disposed in the fill, comprising the steps of:

applying a force (F) to an inside surface of a wall of the pipe, said pipe being permanently disposed in the fill, and thereby obtaining a deformation (D) of the wall directed to an outside surface of the pipe;

measuring a deformation of the fill by measuring the resulting deformation of the wall of the pipe;

computing an elastic modulus of the fill from the applied force and from the measured deformation;

determining a dry density of the fill from the computed elastic modulus and from a nature of the fill; and comparing the determined dry density with a dry density value corresponding to an optimum compaction of the fill.

2. The method according to claim 1, wherein the step of applying the force to the pipe consists in exerting a radial force on two diametrically opposed regions of the wall so as to make the pipe cross section approximately oval.

3. The method according to claim 1, wherein the step of computing the elastic modulus of the fill further comprises the steps of:

computing a stiffness of the fill, by computation of a ratio of a value of the applied force (F) to a value of the resulting deformation (D); and computing the elastic modulus of the fill from the computed stiffness.

4. An apparatus for monitoring a compaction of a fill for embedding a pipe comprising:

means for applying a force to a wall of the pipe so as to deform said wall;

means for measuring a resulting deformation (D) of the wall; and a central processing unit to which said measurement means are connected, said processing unit having means for computing an elastic modulus of the fill from values of the applied force (F) and from the resulting deformation (D) of the wall, means for determining a dry density of the fill from the computed elastic modulus and from the nature of the fill, and means for comparing a dry density value delivered by the computing means with a dry density value corresponding to an optimum compaction of the fill.

5. Monitoring apparatus according to claim 4, wherein the means for applying the force to the wall comprises:

at least one cylinder; and a pressure sensor in a fluid feed circuit for the at least one cylinder and connected to the central processing unit.

6. Monitoring apparatus according to claim 5, further comprising two groups of at least one cylinder, said at least one cylinder of one of the groups exerting, in operation, a first force in a direction opposite to a second force exerted by said at least one cylinder of another of the groups.

7. Monitoring apparatus according to claim 6, wherein each group of cylinders comprises a pair of cylinders placed on either side of the means for measuring the deformation of the pipe.

8. Monitoring apparatus according to claim 7, further comprising two blocks for pressing against an internal surface of the wall, each block being mounted on active ends of the cylinders and on one of the pairs of cylinders.

9. Monitoring apparatus according to claim 8, wherein each block further comprises:

two opposed end regions, each said end region having means for mounting on a cylinder; and a central region, a circular plate for applying the force to the pipe being mounted on an external face of said central region.

10. Monitoring apparatus according to claim 9, wherein each said circular plate and each block have a hole for passage of the means for measuring the deformation of the wall.

11. Monitoring apparatus according to claim 10, wherein each said circular plate has a disk shape, a diameter being approximately equal to one tenth of a diameter of the pipe.

* * * * *